US005806491A

United States Patent [19]

Ohtake

[11] Patent Number: 5,806,491

[45] Date of Patent: Sep. 15, 1998

[54] AIR-COOLED MULTI-CYLINDER ENGINE

[75] Inventor: Yukio Ohtake, Susono, Japan

[73] Assignee: Toyota Jidosha Kabushiki Kaisha, Toyota, Japan

[21] Appl. No.: 825,616

[22] Filed: Mar. 31, 1997

[30] Foreign Application Priority Data

Apr. 1, 1996 [JP] Japan ..... 8-078907

[51] Int. Cl.[6] ..... F02D 41/34

[52] U.S. Cl. ..... 123/435; 123/494; 123/689; 701/103

[58] Field of Search ..... 123/491, 478, 123/435, 494, 689; 701/103

[56] References Cited

U.S. PATENT DOCUMENTS

| | | | |
|---|---|---|---|
| 4,114,442 | 9/1978 | Pratt | 374/113 |
| 4,452,207 | 6/1984 | Moore, Jr. | 123/676 |
| 4,683,854 | 8/1987 | Goulet | 123/435 |
| 4,913,118 | 4/1990 | Watanabe | 123/435 |
| 5,048,491 | 9/1991 | Haiki | 123/479 |

FOREIGN PATENT DOCUMENTS

| | | |
|---|---|---|
| A-62-186037 | 8/1987 | Japan . |
| A-62-206255 | 9/1987 | Japan . |

*Primary Examiner*—Tony M. Argenbright
*Assistant Examiner*—Hieu T. Vo
*Attorney, Agent, or Firm*—Oliff & Berridge, PLC

[57] ABSTRACT

An air-cooled multi-cylinder engine including two temperature sensors each attached to different cylinders. The temperature difference between the two cylinders is detected by the temperature sensors. The air-fuel ratio in each cylinder is made the stoichiometric air-fuel ratio by decreasing the amount of fuel fed into higher temperature cylinders and increasing the amount of fuel fed into lower temperature cylinders.

20 Claims, 9 Drawing Sheets

AIR-COOLED MULTI-CYLINDER ENGINE

BACKGROUND OF THE INVENTION

1. Field of the Invention

The present invention relates to an air-cooled multi-cylinder engine.

2. Description of the Related Art

In water-cooled multi-cylinder engines, the temperatures of the cylinders are not always the same. Therefore, there is known a water-cooled multi-cylinder engine wherein a cooling water temperature at a cooling water outlet of a water jacket formed in the engine body is detected by a temperature sensor, the temperature of the cylinders is estimated from the cooling water temperature, and the air-fuel ratios of the cylinders are controlled so as to give the optimum air-fuel ratios with which knocking does not occur (Japanese Unexamined Patent Publication (Kokai) No. 60-206255).

It is possible to estimate the temperature of the cylinders from the cooling water temperature by detecting the cooling water temperature at the cooling water outlet of the water jacket in the above engine since the temperature of the cylinders of a water-cooled multi-cylinder engine is stable and does not change much at all during the operation of the engine. In an air-cooled multi-cylinder engine, however, the temperature of the cylinders changes considerably according to the amount of the cooling air. In addition, there is a large fluctuating temperature difference between cylinders. Therefore there is a problem that it is impossible to estimate the temperatures of all of the cylinders from only the temperature of one specific portion as in the detection by the above water-cooled multi-cylinder engine.

SUMMARY OF THE INVENTION

An object of the present invention is to provide an air-cooled multi-cylinder engine capable of making the air-fuel ratios in all of the cylinders the target air-fuel ratio even if the temperatures are different in the cylinders.

According to a first aspect of the present invention, there is provided an air-cooled multi-cylinder engine having a plurality of cylinders arranged along a direction of flow of cooling air, the engine comprising temperature sensors attached to at least two cylinders to detect a temperature difference between the two cylinders and air-fuel ratio control means for controlling an air-fuel ratio of each cylinder on the basis of the temperature difference to make the air-fuel ratio in each cylinder a target air-fuel ratio.

According to a second aspect of the present invention, there is provided an air-cooled multi-cylinder engine having a plurality of cylinders which are arranged along a direction of flow of cooling air, the engine comprising detecting means for detecting an amount of cooling air flowing around the cylinders; estimating means for estimating a temperature difference between two cylinders on the basis of the amount of the cooling air; and air-fuel ratio control means for controlling an air-fuel ratio in each cylinder on the basis of the temperature difference to make the air-fuel ratio in each cylinder a target air-fuel ratio.

BRIEF DESCRIPTION OF THE DRAWINGS

The present invention may be more fully understood from the description of the preferred embodiments of the invention set forth below, together with the accompanying drawings, in which.

DESCRIPTION OF THE PREFERRED EMBODIMENTS

An explanation will be made below of a case where the present invention is applied to a reciprocating engine for an aircraft.

Figure 1:
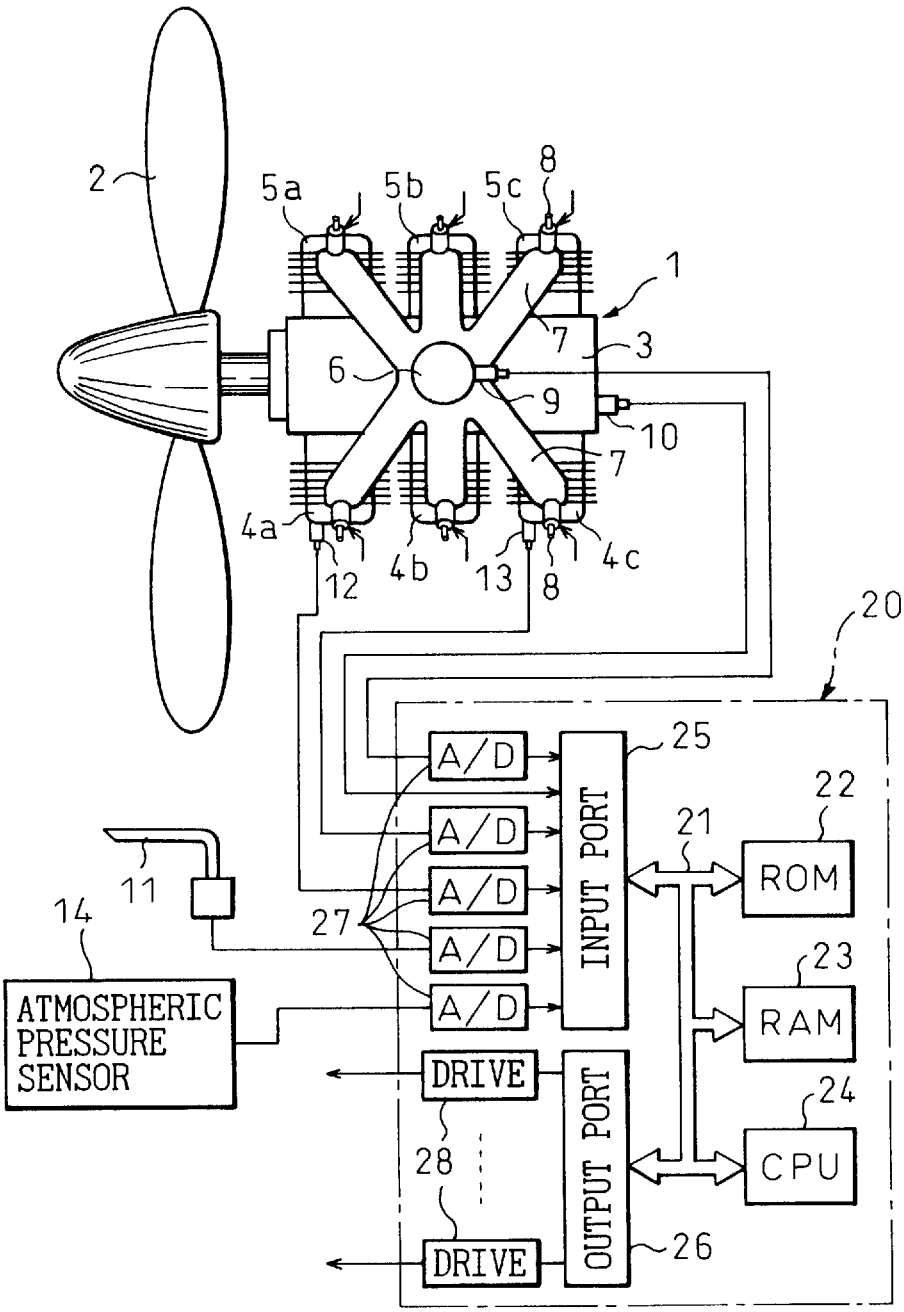
FIG. 1 is an overall view of an air-cooled multi-cylinder engine for an aircraft.

In FIG. 1, 1 denotes a horizontal opposed type six-cylinder engine for driving a propeller 2, 3 a cylinder block, 4*a*, 4*b*, 4*c*, 5*a*, 5*b*, and 5*c* cylinders around which cooling fins are formed, 6 an intake manifold collecting portion, 7 intake manifold tubes extending from the intake manifold collecting portion 6 toward the cylinders 4*a*, 4*b*, 4*c*, 5*a*, 5*b*, and 5*c*, and 8 fuel injectors individually attached to the intake manifold tubes 7.

The cylinders 4*a*, 4*b*, and 4*c* are arranged aligned at intervals along the direction of flow of the cooling air. The cylinder 4*a* among these cylinders is located upstream in the direction of flow of the cooling air, and the cylinder 4*c* is located downstream in the direction of flow of the cooling air. Accordingly, below, the cylinder 4*a* will be referred to as an upstream cylinder, the cylinder 4*c* will be referred to as a downstream cylinder, and the cylinder 4*b* located between these cylinders 4*a* and 4*c* will be referred to as the intermediate cylinder.

Similarly, the cylinders 5*a*, 5*b*, and 5*c* are arranged aligned at intervals along the direction of flow of the cooling air. The cylinder 5*a* among these cylinders is located upstream in the direction of flow of the cooling air, while the cylinder 5*c* is located downstream in the direction of flow of the cooling air. Accordingly, below, the cylinder 5*a* will be referred to as an upstream cylinder, the cylinder 5*c* will be referred to as a downstream cylinder, and the cylinder 5*b* located between these cylinders 5*a* and 5*c* will be referred to as an intermediate cylinder.

Reference numeral 20 shows an electronic control unit which comprises a digital computer and is provided with a read only memory (ROM) 22, a random access memory (RAM) 23, a CPU (microprocessor) 24, an input port 25, and an output port 26 connected to each other by a bidirectional bus 21. The intake manifold collecting portion 6 has attached to it a pressure sensor 9 generating an output voltage proportional to an absolute pressure in the intake manifold collecting portion 6. The output voltage of this pressure sensor 9 is input to the input port 25 via a corresponding analog-to-digital (AD) converter 27. Further, the cylinder block 3 has attached to it a crank angle sensor 10 generating an output pulse representing the engine speed. The output pulse of this crank angle sensor 10 is input to the input port 25.

Further, the aircraft is provided with a Pitot tube 11 for detecting the flight speed. The detection signal of this Pitot tube 11 is input to the input port 25 via the corresponding AD converter 27. Further, the cylinder head of the upstream cylinder 4*a* has attached to it a temperature sensor 12 generating an output voltage proportional to the temperature of the upstream cylinder 4*a*. The output voltage of this temperature sensor 12 is input to the input port 25 via the corresponding AD converter 27. On the other hand, the cylinder head of the downstream cylinder 4*c* has attached to it a temperature sensor 13 generating an output voltage proportional to the temperature of the downstream cylinder 4*c*. The output voltage of this temperature sensor 13 is input to the input port 25 via the corresponding AD converter 27. Further, the input port 25 receives as input the output signal of an atmospheric pressure sensor 14 indicating the atmospheric pressure via the corresponding AD converter 27. On the other hand, the output port 26 is connected to the fuel injectors 8 via a corresponding drive circuit 28.

In the embodiment according to the present invention, the fuel injection time TAU from each fuel injector 8 is calculated based on the following formula:

$$TAU=K\cdot TP$$

Here, K indicates a correction coefficient, and TP indicates a basic fuel injection time. The basic fuel injection time TP is an injection time necessary for controlling the air-fuel ratio to the target air-fuel ratio. This basic fuel injection time TP is found in advance by experiments and is stored in the ROM 22 in advance in the form of the map shown in FIG. 2 as a function of the absolute pressure PM in the intake manifold collecting portion 6 and the engine speed N.

On the other hand, the correction coefficients K are provided so as to maintain the air-fuel ratios in the cylinders at the target air-fuel ratio even if there is a temperature difference among the cylinders. Namely, the higher the temperature of a cylinder, the higher the temperature of the intake passage and the combustion chamber of the cylinder. Therefore, the temperature of the air sucked into that cylinder rises, thus the mass of the air sucked into that cylinder (hereinafter simply referred to as the amount of intake air) is reduced. In other words, if a temperature difference occurs among the cylinders, the amount of intake air at the cylinder having the higher temperature is reduced, while the amount of intake air at the cylinder having the lower temperature is increased. In the embodiment shown in FIG. 1, the temperature of the upstream cylinders 4*a* and 4*b* becomes the lowest, the temperature of the downstream cylinders 4*c* and 5*c* becomes the highest, and the temperature of the intermediate cylinders 4*b* and 5*b* becomes substantially the average temperature of the temperature of the upstream cylinders 4*a* and 5*a* and the temperature of the downstream cylinders 4*c* and 5*c*. Accordingly, the amount of intake air sucked into the upstream cylinders 4*a* and 5*a* becomes larger in comparison with the amount of intake air sucked into the intermediate cylinders 4*b* and 5*b*, and the amount of intake air sucked into the downstream cylinders 4*c* and 5*c* becomes smaller in comparison with the amount of intake air sucked into the intermediate cylinders 4*b* and 5*b*.

When the intake air is uniformly fed into the cylinders, when the fuel injection is carried out from the fuel injectors 8 according to the basic fuel injection time TP, the air-fuel ratios in the cylinders become the target air-fuel ratio. When a difference occurs in the amounts of intake air of the cylinders, however, the air-fuel ratio becomes the target air-fuel ratio in the cylinder where the amount of intake air coincides with the mean value of the total amount of intake air of all cylinders, but the air-fuel ratio becomes leaner than the target air-fuel ratio in the cylinder where the amount of intake air is larger than the mean value of the total amount of intake air, and the air-fuel ratio becomes richer than the target air-fuel ratio in the cylinder where the amount of intake air is smaller than the mean value of the total amount of intake air.

The amount of intake air sucked into a cylinder is substantially proportional to the temperature of the cylinder. On the other hand, as mentioned before, the temperature of the intermediate cylinders 4*b* and 5*b* is substantially the average temperature of the temperature of the upstream cylinders 4*a* and 5*a* and the temperature of the downstream cylinders 4*c* and 5*c*. Accordingly, the amount of intake air sucked into the intermediate cylinders 4*b* and 5*b* substantially coincides with the mean value of the total amount of intake air to all of the cylinders, therefore the air-fuel ratio of the intermediate cylinders 4*b* and 5*b* becomes substantially the target air-fuel ratio.

Contrary to this, the amount of air sucked into the upstream cylinders 4*a* and 5*a* is larger than the mean value of the total amount of intake air, therefore the air-fuel ratios of the upstream cylinders 4*a* and 5*a* become lean. On the other hand, the amount of air sucked into the downstream cylinders 4*c* and 5*c* is smaller than the mean value of the total amount of intake air, and therefore the air-fuel ratios of the downstream cylinders 4*c* and 5*c* become rich. In this case, the larger the temperature difference ΔT between the temperature of the upstream cylinders 4*a* and 5*a* and the temperature of the intermediate cylinders 4*b* and 5*b*, the larger the amount of intake air sucked into the upstream cylinders 4*a* and 5*a* compared with the amount of intake air sucked into the intermediate cylinders 4*b* and 5*b*, therefore to maintain the air-fuel ratios of the upstream cylinders 4*a* and 5*a* at the target air-fuel ratio, the larger the temperature difference ΔT, the more it is necessary to make the values of the correction coefficients K larger with respect to the basic fuel injection time TP.

Contrary to this, the larger the temperature difference ΔT between the temperature of the downstream cylinders 4*c* and 5*c* and the temperature of the intermediate cylinders 4*b* and 5*b*, the smaller the amount of intake air sucked into the downstream cylinders 4*c* and 5*c* in comparison with the amount of intake air sucked into the intermediate cylinders 4*b* and 5*b*. Accordingly, to maintain the air-fuel ratios of the downstream cylinders 4*c* and 5*c* at the target air-fuel ratio, it is necessary to make the values of the correction coefficients K with respect to the basic fuel injection time TP smaller as the temperature difference ΔT becomes larger.

Figure 3:
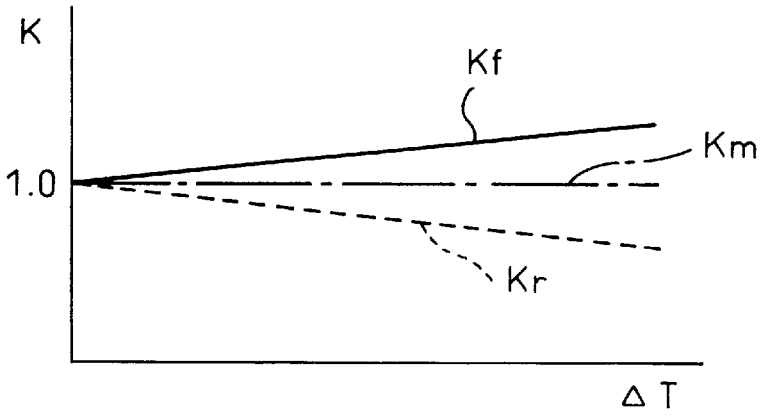
FIG. 3 is a view of correction coefficients Kf, Km, and Kr.

FIG. 3 shows the relationship among the correction coefficients K necessary for bringing the air-fuel ratios of the cylinders to the target air-fuel ratio, that is, the correction coefficient Kf with respect to the upstream cylinders 4*a* and 5*a*, the correction coefficient Kr with respect to the downstream cylinders 4*c* and 5*c*, and the correction coefficient Km with respect to the intermediate cylinders 4*b* and 5*b*, and the temperature difference ΔT. As shown in FIG. 3, the correction coefficient Kf with respect to the upstream cylinders 4*a* and 5*a* is larger than 1.0 and becomes larger as the temperature difference ΔT becomes larger, and the correction coefficient Kr with respect to the downstream cylinders 4*c* and 5*c* is smaller than 1.0 and becomes smaller as the temperature difference ΔT becomes larger. Further, the correction coefficient Km with respect to the intermediate cylinders 4*b* and 5*b* is fixed to 1.0 regardless of the temperature difference ΔT in the present invention. Note that, the temperature difference ΔT between the upstream cylinders 4*a* and 5*a* and the intermediate cylinders 4*b* and 5*b* becomes substantially equal to the temperature difference ΔT between the downstream cylinders 4*c* and 5*c* and the intermediate cylinders 4*b* and 5*b,* therefore either temperature difference ΔT can be used as the temperature difference ΔT for finding the correction coefficients Kf, Kr, and Km.

Figure 4:
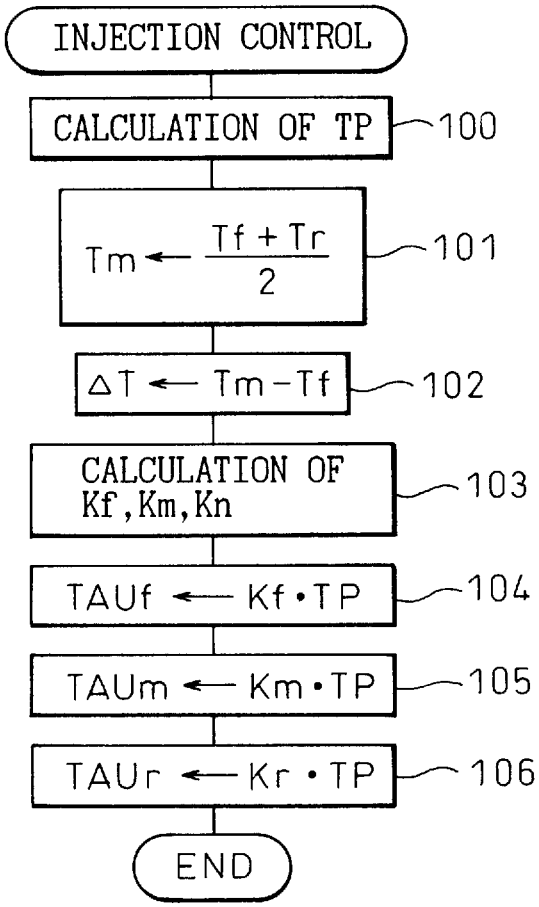
FIG. 4 is a flowchart for controlling the fuel injection.

FIG. 4 shows a routine for controlling the fuel injection from the fuel injectors 8. This routine is executed by interruption every predetermined time interval.

Figure 2:
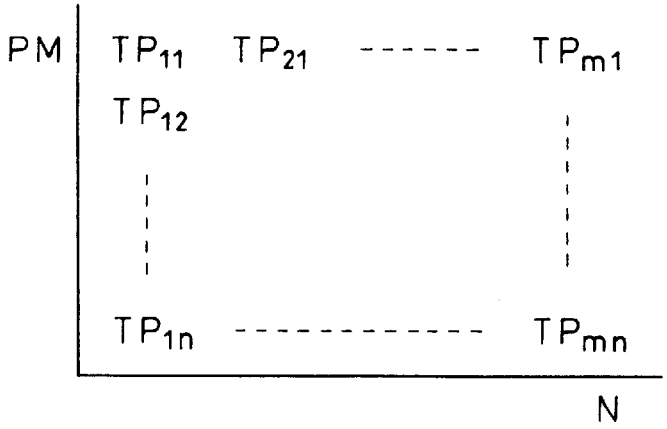
FIG. 2 is a map showing a basic fuel injection time TP.

Referring to FIG. 4, first of all, the basic fuel injection time TP is calculated from the map shown in FIG. 2 at step 100. Then, at step 101, the mean value of the temperature Tf of the upstream cylinder 4*a* detected by the temperature sensor 12 and the temperature Tr of the downstream cylinder 4*c* detected by the temperature sensor 13 is brought to the temperature Tm of the intermediate cylinder 4*b*. Subsequently, at step 102, Tf is subtracted from Tm, whereby the temperature difference ΔT (=Tm−Tf) between the temperature Tm of the intermediate cylinder 4*b* and the upstream cylinder 4*a* is calculated.

Figure 5:
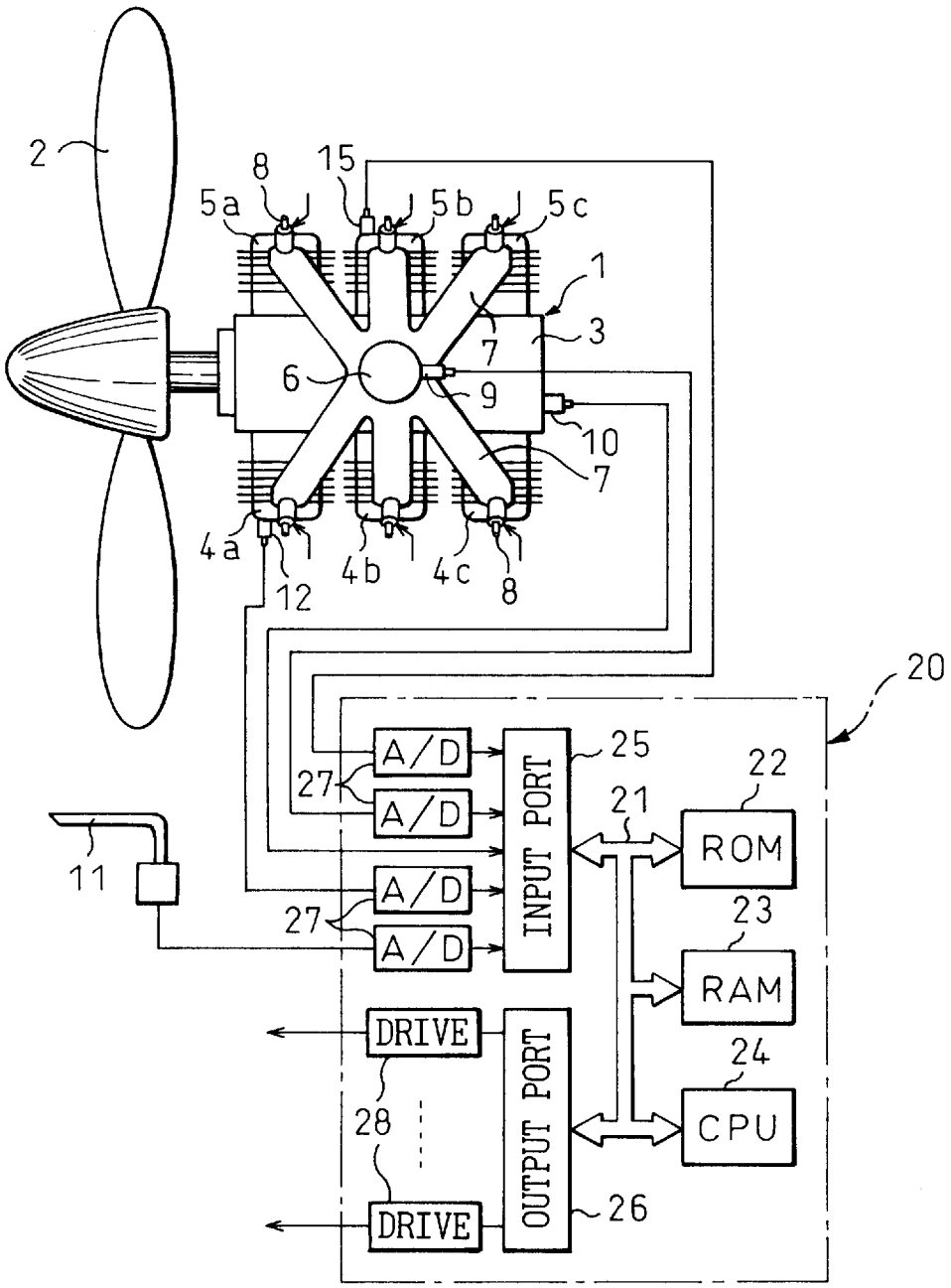
FIG. 5 is an overall view of another embodiment of the air-cooled multi-cylinder engine for an aircraft.
Figure 6:
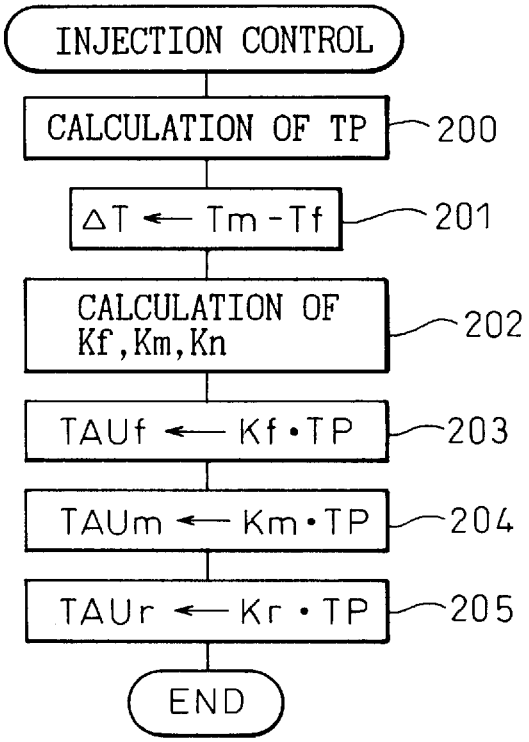
FIG. 6 is a flowchart for controlling the fuel injection.

Then, at step 103, the correction coefficient Kf with respect to the upstream cylinders 4*a* and 5*a,* the correction coefficient Km with respect to the intermediate cylinders 4*b* and 5*b,* and the correction coefficient Kr with respect to the downstream cylinders 4*c* and 5*c* are calculated from the temperature difference ΔT based on the relationship shown in FIG. 3. Subsequently, at step 104, the basic fuel injection time TP is multiplied by the correction coefficient Kf, whereby the fuel injection time TAUf (=Kf·TP) with respect to the upstream cylinders 4*a* and 5*a* is calculated, and then, at step 105, the basic fuel injection time TP is multiplied by the correction coefficient Km, whereby the fuel injection time TAUm (=Km·TP) with respect to the intermediate cylinders 4*b* and 5*b* is calculated, and then, at step 106, the basic fuel injection time TP is multiplied by the correction coefficient Kr, whereby the fuel injection time TAUr (=Kr·TP) with respect to the downstream cylinders 4*c* and 5*c* is calculated FIG. 5 and FIG. 6 show another embodiment. As shown in FIG. 5, in this embodiment, the temperature sensor is not provided at the downstream cylinder 4*c*. Rather, a temperature sensor 15 is provided at the intermediate cylinder 5*b*. In this embodiment, the temperature difference ΔT between the temperature Tf of the upstream cylinder 4*a* and the temperature Tm of the intermediate cylinder 5*b* is directly detected, and the correction coefficients Kf, Km, and Kr are calculated based on this temperature difference ΔT.

FIG. 6 shows a routine for controlling the fuel injection from the fuel injectors 8. This routine is executed by interruption at every predetermined time interval.

Referring to FIG. 6, first of all, the basic fuel injection time TP is calculated from the map shown in FIG. 2 at step 200. Then, at step 201, the temperature Tf of the upstream cylinder 4*a* detected by the temperature sensor 12 is subtracted from the temperature Tm of the intermediate cylinder 5*b* detected by the temperature sensor 15, whereby the temperature difference ΔT (=Tm−Tf) between the temperature Tm of the intermediate cylinder 5*b* and the temperature Tf of the upstream cylinder 4*a* is calculated.

Figure 7:
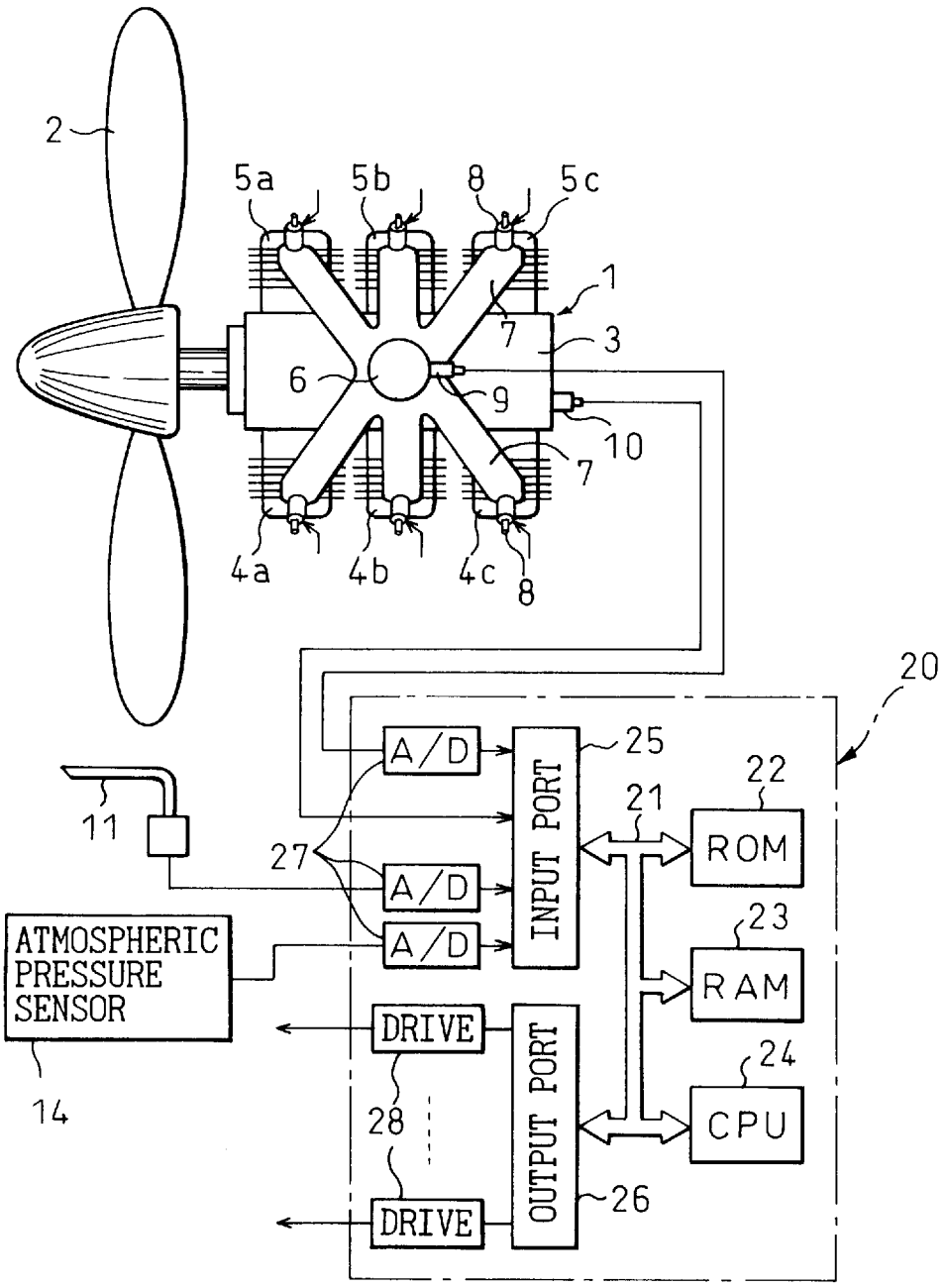
FIG. 7 is an overall view of still another embodiment of the air-cooled multi-cylinder engine for an aircraft.
Figure 8A:
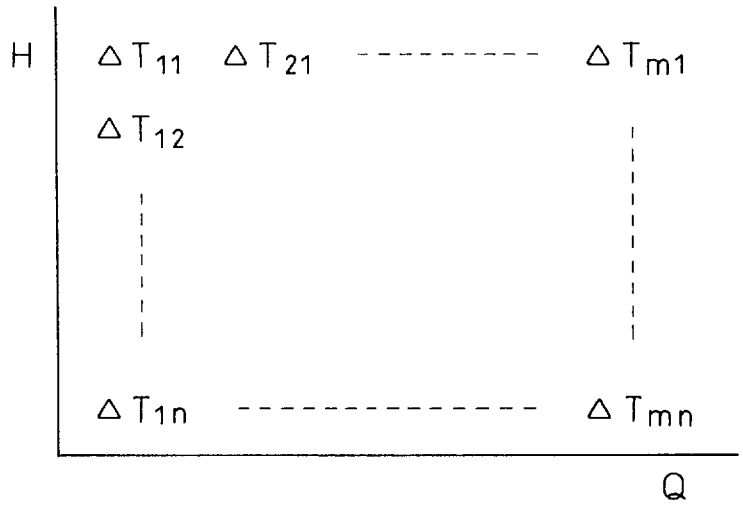
FIGS. 8A and 8B are views of a map of a temperature difference ΔT etc.
Figure 8B:
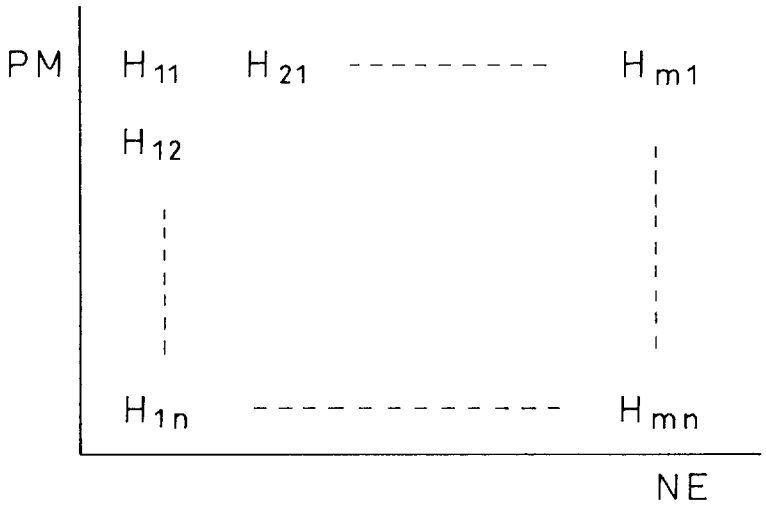
Figure 9:
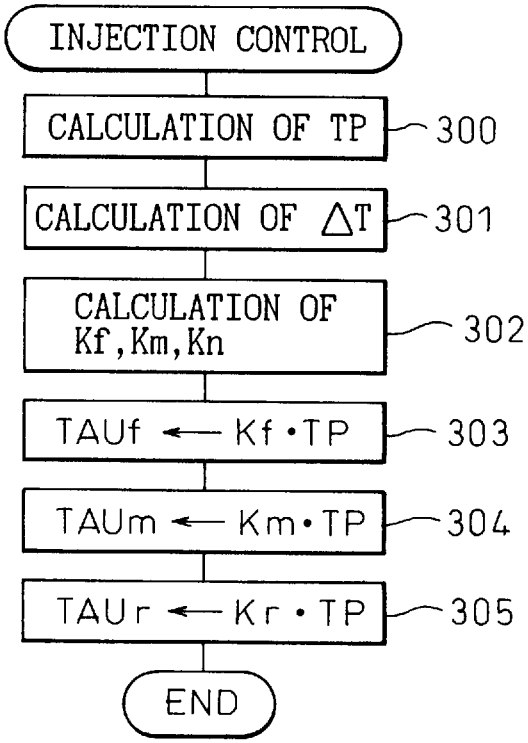
FIG. 9 is a flowchart of the control of the fuel injection.

Then, at step 202, the correction coefficient Kf with respect to the upstream cylinders 4*a* and 5*a,* the correction coefficient Km with respect to the intermediate cylinders 4*b* and 5*b,* and the correction coefficient Kr with respect to the downstream cylinders 4*c* and 5*c* are calculated from the temperature difference ΔT based on the relationship shown in FIG. 3. Subsequently, at step 203, the basic fuel injection time TP is multiplied by the correction coefficient Kf, whereby the fuel injection time TAUf (=Kf·TP) with respect to the upstream cylinders 4*a* and 5*a* is calculated, and then, at step 204, the basic fuel injection time TP is multiplied by the correction coefficient Km, whereby the fuel injection time TAUm (=Km·TP) with respect to the intermediate cylinders 4*b* and 5*b* is calculated, and then, at step 205, the basic fuel injection time TP is multiplied by the correction coefficient Kr, whereby the fuel injection time TAUr (=Kr·TP) with respect to the downstream cylinders 4*c* and 5*c* is calculated FIG. 7 to FIG. 9 show still another embodiment. As shown in FIG. 7, in this embodiment, the temperature sensor for detecting the temperature of the cylinder is not provided. Accordingly, in this embodiment, the temperature difference ΔT among the cylinders, for example, the temperature difference ΔT between the upstream cylinder 4*a* and the intermediate cylinder 4*b,* is estimated.

Namely, the temperature difference among the cylinders is determined according to a balance between the amount of heat generated by the combustion in the cylinders and the amount of cooling of the cylinders by the cooling air. In this case, the amount of cooling of the cylinders is proportional to the mass flow rate of the cooling air flowing around the cylinders and further proportional to the temperature difference between the temperature of the cooling air and the cylinder temperature. When it is now assumed that the mass flow rate of the cooling air is substantially constant, the larger the amount of heat generated by the cylinders, the larger the temperature difference ΔT among the cylinders. Namely, when the amount of heat generated by the upstream cylinder 4*a* and the intermediate cylinder 4*b* becomes large, the amount of heat absorbed by the cooling air flowing around the upstream cylinder 4*a* is increased, and the amount of rise of temperature of the cooling air becomes large. When the amount of rise of temperature of the cooling air becomes large, the temperature difference between the cooling air and the intermediate cylinder 4*b* becomes small, so the cooling effect with respect to the intermediate cylinder 4*b* becomes weaker than the cooling effect with respect to the upstream cylinder 4*a* and thus the temperature difference ΔT between the upstream cylinder 4*a* and the intermediate cylinder 4*b* becomes large.

On the other hand, if the amounts of heat generated by the cylinders are substantially constant, the larger the mass flow rate of the cooling air around the cylinders, the smaller the temperature difference ΔT among the cylinders. Namely, along with an increase of the mass flow rate of the cooling air, the amount of heat absorbed by the cooling air per unit mass is lowered, so the amount of rise of temperature of the cooling air flowing around the upstream cylinder 4*a* becomes smaller. As a result, the temperature difference between the cooling air and the intermediate cylinder 4*b* becomes large, so the cooling effect with respect to the intermediate cylinder 4*b* is raised. Thus, the larger the mass flow rate of the cooling air around the cylinder, the smaller the temperature difference ΔT among the cylinders.

In this way, the temperature difference ΔT among the cylinders becomes a function of the amount of heat generated of the cylinders and the mass flow rate of the cooling air flowing around the cylinders. In this embodiment according to the present invention, the temperature difference ΔT between the upstream cylinder 4*a* and the intermediate cylinder 4*b* is stored in the ROM 22 in advance in the form of the map shown in FIG. 8A as a function of the amount of heat generated H of the cylinders and the mass flow rate Q of the cooling air flowing around the cylinders.

Here, the mass flow rate Q of the cooling air is calculated by multiplying the flight speed of the aircraft detected by the Pitot tube 11 and the atmospheric density detected by the atmospheric pressure sensor 14. On the other hand, the amount of heat generated H of a cylinder becomes a function of the absolute pressure PM in the intake manifold header 6 and the engine speed NE. Namely, the higher the absolute pressure PM in the intake manifold header 6 and the higher the engine speed NE, the larger the amount of heat generated H of the cylinder. The relationships between the amount of heat generated H and the absolute pressure PM in the intake manifold header 6 and the engine speed NE are stored in the ROM 22 in advance in the form of the map shown in FIG. 8B, therefore the amount of heat generated H of the cylinder is calculated from the map shown in FIG. 8B.

FIG. 9 shows the routine for controlling the fuel injection from the fuel injectors 8. This routine is executed by interruption at every predetermined time interval.

Referring to FIG. 9, first of all, the basic fuel injection time TP is calculated from the map shown in FIG. 2 at step 300. Then, at step 301, the temperature difference ΔT is calculated from the map shown in FIG. 8A and FIG. 8B. Namely, the mass Q of the cooling air is calculated from the detection signals of the Pitot tube 11 and the atmospheric pressure sensor 14, the amount of heat generated H is calculated from the map shown in FIG. 8B, and the temperature difference ΔT between the upstream cylinder 4*a* and the intermediate cylinder 4*b* is calculated from the map shown in FIG. 8A based on these mass Q of the cooling air and the amount of heat generated H.

Figure 10:
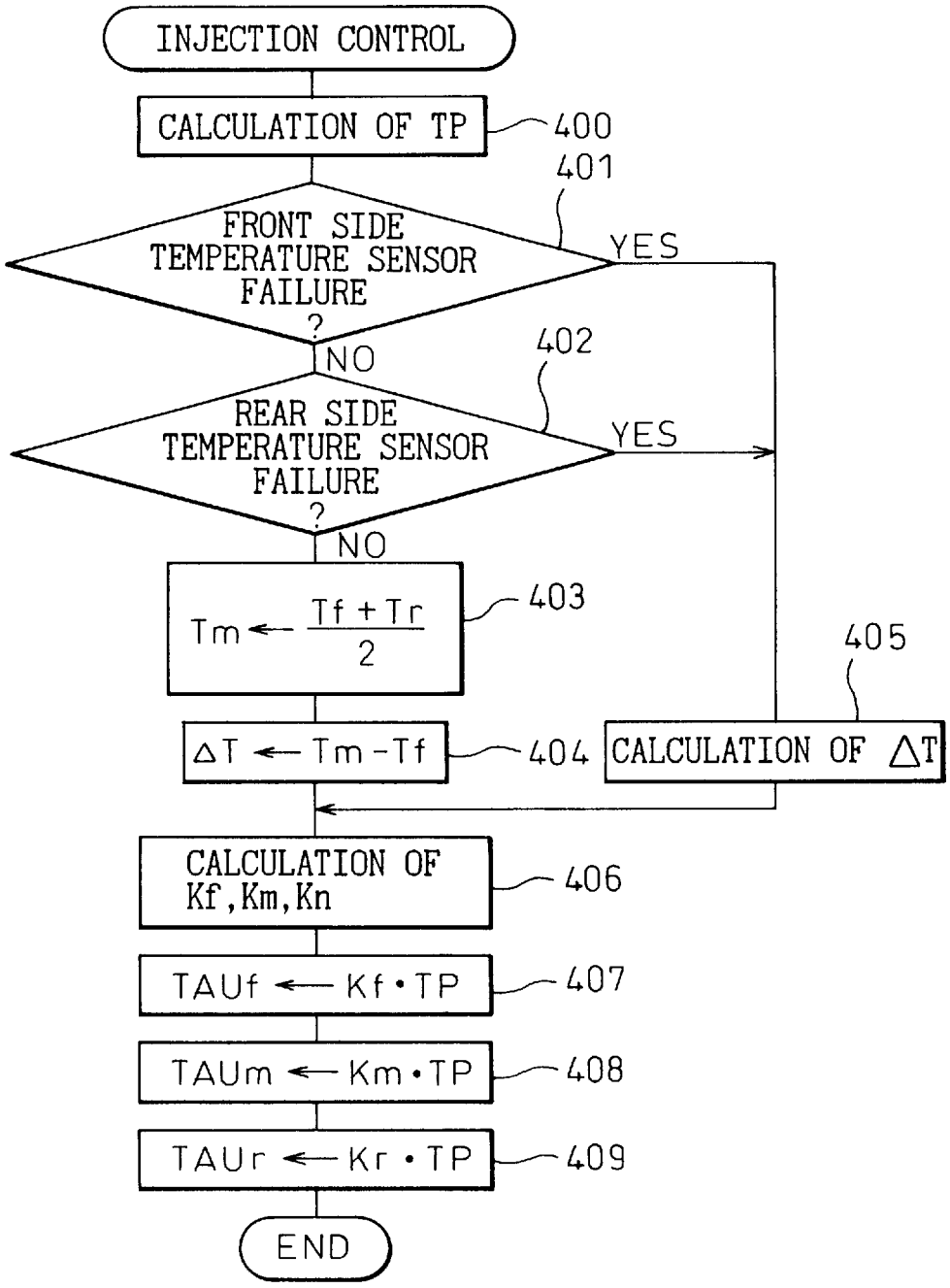
FIG. 10 is a flowchart of another embodiment of the control of the fuel injection.

Then, at step 302, the correction coefficient Kf with respect to the upstream cylinders 4*a* and 5*a,* the correction coefficient Km with respect to the intermediate cylinders 4*b* and 5*b,* and the correction coefficient Kr with respect to the downstream cylinders 4*c* and 5*c* are calculated from the temperature difference ΔT based on the relationship shown in FIG. 3. Subsequently, at step 303, the basic fuel injection time TP is multiplied by the correction coefficient Kf, whereby the fuel injection time TAUf (=Kf·TP) with respect to the upstream cylinders 4*a* and 5*a* is calculated, and then, at step 304, the basic fuel injection time TP is multiplied by the correction coefficient Km, whereby the fuel injection time TAUm (=Km·TP) with respect to the intermediate cylinders 4*b* and 5*b* is calculated, and then, at step 305, the basic fuel injection time TP is multiplied by the correction coefficient Kr, whereby the fuel injection time TAUr (=Kr·TP) with respect to the downstream cylinders 4*c* and 5*c* is calculated FIG. 10 shows still another embodiment. In this embodiment, as shown in FIG. 1, the temperature sensors 12 and 13 are attached to the upstream cylinder 4*a* and the downstream cylinder 4*c*. Usually, the temperature difference ΔT is calculated from the temperatures detected by these temperature sensors 12 and 13. Further, in this embodiment, if an abnormality occurs in either one of the temperature sensors 12 and 13, the temperature difference ΔT is calculated from the map based on FIG. 8A and FIG. 8B. Note that, in this embodiment, when the output voltage of the temperature sensor 12 becomes a usually impossible value, it is determined that an abnormality has occurred in the temperature sensor 12. This same is true for the temperature sensor 13.

FIG. 10 shows the routine for controlling the basic fuel injection from the fuel injectors 8. This routine is executed by interruption at every predetermined time interval.

Referring to FIG. 10, first of all, the basic fuel injection time TP is calculated from the map shown in FIG. 2 at step 400. Then, at step 401, it is decided whether or not an abnormality has occurred in the front side temperature sensor 12. When no abnormality has occurred, the operation routine proceeds to step 402, at which it is decided whether or not the abnormality occurs in the rear temperature sensor 13. When no abnormality occurs, the operation routine proceeds to step 403, at which the mean value of the temperature Tf of the upstream cylinder 4*a* detected by the temperature sensor 12 and the temperature Tr of the downstream cylinder 4*c* detected by the temperature sensor 13 is brought to the temperature Tm of the intermediate cylinder 4*b*. Subsequently, at step 404, Tf is subtracted from Tm, whereby the temperature difference ΔT (=Tm−Tf) between the temperature Tm of the intermediate cylinder 4*b* and the temperature of the upstream cylinder 4*a* is calculated.

Then, at step 406, the correction coefficient Kf with respect to the upstream cylinders 4*a* and 5*a,* the correction coefficient Km with respect to the intermediate cylinders 4*b* and 5*b,* and the correction coefficient Kr with respect to the downstream cylinders 4*c* and 5*c* are calculated from the temperature difference ΔT based on the relationship shown in FIG. 3. Subsequently, at step 407, the basic fuel injection time TP is multiplied by the correction coefficient Kf, whereby the fuel injection time TAUf (=Kf·TP) with respect to the upstream cylinders 4*a* and 5*a* is calculated, and then, at step 408, the basic fuel injection time TP is multiplied by the correction coefficient Km, whereby the fuel injection time TAUm (=Tm·TP) with respect to the intermediate cylinders 4*b* and 5*b* is calculated, and then, at step 409, the basic fuel injection time TP is multiplied by the correction coefficient Kr, whereby the fuel injection time TAUr (=Kr·TP) with respect to the downstream cylinders 4*c* and 5*c* is calculated Contrary to this, when it is determined at step 401 that an abnormality has been caused in the front temperature sensor 12 or when it is determined at step 402 that an abnormality has been caused in the rear temperature sensor 13, the operation routine proceeds to step 405, at which the temperature difference ΔT is calculated from the map shown in FIG. 8A and FIG. 8B. Namely, the mass Q of the cooling air is calculated from the detection signals of the Pitot tube 11 and the atmospheric pressure sensor 14, the amount of heat generated H is calculated from the map shown in FIG. 8B, and the temperature difference ΔT between the upstream cylinder 4*a* and the intermediate cylinder 4*b* is calculated from the map shown in FIG. 8A based on the mass Q and the amount of heat generated H of the cooling air. Then, the operation routine proceeds to step 406.

According to the present invention, even in a case where a temperature difference is caused among the cylinders in an air-cooled multi-cylinder engine, the air-fuel ratios of the cylinders can be controlled to the target air-fuel ratio. In an engine for aircraft, the temperature difference among the cylinders greatly changes when taxing on the airport runway or during flight, therefore a remarkable effect is obtained particularly when the present invention is applied to an engine for aircraft.

While the invention has been described by reference to specific embodiments chosen for purposes of illustration, it should be apparent that numerous modifications could be made thereto by those skilled in the art without departing from the basic concept and scope of the invention.

I claim:

1. An air-cooled multi-cylinder engine having a plurality of cylinders arranged along a direction of flow of a cooling air, said engine comprising:

temperature sensors attached to at least two cylinders to detect a temperature difference between said two cylinders and air-fuel ratio control means for controlling an air-fuel ratio of in each cylinder on the basis of said temperature difference to make the air-fuel ratio in each cylinder a target air-fuel ratio.

2. An air-cooled multi-cylinder engine according to claim 1, wherein said temperature sensors are attached to one cylinder among the plurality of cylinders and another cylinder located downstream from said one cylinder in the direction of flow of the cooling air.

3. An air-cooled multi-cylinder engine according to claim 2, wherein the cylinder located next downstream from said one cylinder is said other cylinder.

4. An air-cooled multi-cylinder engine according to claim 2, wherein the cylinder located further downstream from the cylinder located next downstream from said one cylinder is said other cylinder.

5. An air-cooled multi-cylinder engine according to claim 1, wherein said plurality of cylinders are aligned along the direction of flow of the cooling air.

6. An air-cooled multi-cylinder engine according to claim 1, wherein said plurality of cylinders comprise two banks of cylinders arranged along the direction of flow of the cooling air; and said two temperature sensors are attached to a cylinder of one bank and a cylinder of the other bank.

7. An air-cooled multi-cylinder engine according to claim 1, wherein said air-fuel ratio control means brings the air-fuel ratio of each cylinder to the target air-fuel ratio by controlling the fuel injection amount.

8. An air-cooled multi-cylinder engine according to claim 7, wherein said air-fuel ratio control means corrects the basic fuel injection time determined from the operation state of the engine based on said temperature difference to thereby bring the air-fuel ratio of each cylinder to the target air-fuel ratio; and the relationship between the correction amount with respect to said basic fuel injection time and said temperature difference is stored in advance.

9. An air-cooled multi-cylinder engine according to claim 1, further comprising detecting means for detecting the amount of the cooling air flowing around the cylinder, estimating means for estimating the temperature difference between two cylinders based on the amount of said cooling air, and deciding means for deciding whether or not a temperature sensor has broken down; and said air-fuel ratio control means controls the air-fuel ratio of each cylinder to the target air-fuel ratio based on the temperature difference estimated by said estimating means when it is decided by said deciding means that at least one temperature sensor has broken down.

10. An air-cooled multi-cylinder engine according to claim 9, wherein the amount of said cooling air is found from a flight speed of an aircraft and atmospheric density.

11. An air-cooled multi-cylinder engine according to claim 10, wherein said flight speed is detected by a Pitot tube.

12. An air-cooled multi-cylinder engine according to claim 9, wherein said estimating means estimates the temperature difference between two cylinders based on the amount of said cooling air and the amount of heat generated of each cylinder.

13. An air-cooled multi-cylinder engine according to claim 12, wherein said amount of heat generated is stored in advance as a function of the operating state of the engine.

14. An air-cooled multi-cylinder engine having a plurality of cylinders which are arranged along a direction of flow of a cooling air, said engine comprising:

detecting means for detecting an amount of cooling air flowing around the cylinders;

estimating means for estimating a temperature difference between two cylinders on the basis of said amount of the cooling air; and air-fuel ratio control means for controlling an air-fuel ratio in each cylinder on the basis of said temperature difference to make the air-fuel ratio in each cylinder a target air-fuel ratio.

15. An air-cooled multi-cylinder engine according to claim 14, wherein the amount of said cooling air is found from a flight speed of an aircraft and atmospheric density.

16. An air-cooled multi-cylinder engine according to claim 15, wherein said flight speed is detected by a Pitot tube.

17. An air-cooled multi-cylinder engine according to claim 14, wherein said estimating means estimates the temperature difference between two cylinders based on said amount of the cooling air and the amount of heat generated of each cylinder.

18. An air-cooled multi-cylinder engine according to claim 17, wherein said amount of heat generated is stored in advance as a function of the operating state of the engine.

19. An air-cooled multi-cylinder engine according to claim 14, wherein said air-fuel ratio control means makes the air-fuel ratio in each cylinder the target air-fuel ratio by controlling the fuel injection amount.

20. An air-cooled multi-cylinder engine according to claim 19, wherein said air-fuel ratio control means makes the air-fuel ratio in each cylinder the target air-fuel ratio by correcting the basic fuel injection time determined from the operating state of the engine on the basis of said temperature difference; and the relationship between the correction amount with respect to said basic fuel injection time and said temperature difference is stored in advance.

* * * * *